US006040279A

United States Patent [19]

Addagarla et al.

[11] Patent Number: 6,040,279

[45] **Date of Patent: *Mar. 21, 2000**

[54] LUBRICANT COMPOSITION SUITABLE FOR DIRECT FUEL INJECTED, CRANKCASE-SCAVENGED TWO-STROKE CYCLE ENGINES

[75] Inventors: Sumanth Addagarla, Richmond; Glenn E. Callis, Walnut Creek, both of Calif.

[73] Assignee: Chevron Chemical Company LLC, San Francisco, Calif.

[ * ] Notice: This patent is subject to a terminal disclaimer.

[21] Appl. No.: 09/104,075

[22] Filed: Jun. 24, 1998

Related U.S. Application Data

[62] Division of application No. 08/790,558, Nov. 25, 1996, Pat. No. 5,866,520

[60] Provisional application No. 60/010,936, Jan. 31, 1996.

[51] Int. Cl.[7] ..... C10M 129/68

[52] U.S. Cl. ..... 508/437; 508/486

[58] Field of Search ..... 508/437, 486

[56] References Cited

U.S. PATENT DOCUMENTS

| | | | |
|---|---|---|---|
| 3,004,837 | 10/1961 | Riemenschneider | 44/443 |
| 3,085,975 | 4/1963 | Jennings | 210/58 |
| 3,753,905 | 8/1973 | Souillard et al. | 252/33.4 |
| 5,064,546 | 11/1991 | Dasai | 508/437 |

*Primary Examiner*—Gabrielle Brouillette
*Assistant Examiner*—Cephia D. Toomer
*Attorney, Agent, or Firm*—Richard J. Sheridan

[57] ABSTRACT

A lubricant composition is disclosed that is suitable for direct fuel injected, crankcase-scavenged two-stroke cycle engines. That lubricant composition has a major amount of at least one oil of lubricating viscosity, a minor amount of a lubricity additive, a polyalkyl amide, an imidazoline, a polyisobutylene, and a functionalized polyisobutylene. The lubricity additive contains glycerol monooleate, an acid aliphatic aromatic amine-phosphate, and sodium sulfonate. The acid aliphatic aromatic amine-phosphate has a phosphorus/oxygen atom ratio of from 4.0:1 to 4.5:1, and at least 1.2 equivalents of acid to 1.0 equivalents of base.

6 Claims, No Drawings

LUBRICANT COMPOSITION SUITABLE FOR DIRECT FUEL INJECTED, CRANKCASE-SCAVENGED TWO-STROKE CYCLE ENGINES

This application is a division of application Ser. No. 08/790,558, now U.S. Pat. No. 5,866,520, filed Nov. 25, 1996, which claims priority under 35 U.S.C. §119(e) based upon provisional application Ser. No. 60/010,936, filed Jan. 31, 1996.

This invention relates to lubricant compositions, and fuel-lubricant mixtures useful in two-stroke cycle engines. The invention also includes a method of controlling piston scuffing and the prevention of ring wear.

BACKGROUND OF THE INVENTION

Over the past several decades the use of spark ignited two-stroke internal combustion engines has steadily increased. They are presently found in power lawn mowers and other power operated garden equipment, power chain saws, pumps, electrical generators, marine outboard engines, snowmobiles, motorcycles and the like.

The increasing use of two-stroke cycle engines, coupled with increasing severity of the conditions in which they have operated, has led to an increased demand for oils to adequately lubricate such engines. Among the problems associated with two-stroke cycle engines is piston lubricity, scuffing or scoring. This condition is generally controlled by adding relatively high viscosity oils (greater than or equal to 100 centistokes (cSt) at 40° C.) or bright stock. The higher viscosity oils and bright stock act to increase viscosity and prevent piston seizure. A problem associated with the use of these materials is deposit or varnish formation in the combustion chamber, which may lead to preignition. High molecular weight polymers may be used to replace some or all of bright stock in two-stroke cycle engines. The polymer acts to increase viscosity and prevent piston seizure. The problem associated with the use of bright stock or high viscosity oils or high molecular weight polymers is that the products tend to cause fouling of the spark plug in a two-stroke cycle engine.

The unique problems and techniques associated with the lubrication of two-stroke cycle engines has led to the recognition by those skilled in the art of two-stroke cycle engine lubricants as a distinct lubricant type. See, for example, U.S. Pat. Nos. 3,085,975; 3,004,837; and 3,753,905.

The compositions of the present invention are effective in controlling piston scuffing and ring wear. These benefits are obtained without requiring the use need of high molecular weight polymers, bright stock or high viscosity oils.

SUMMARY OF THE INVENTION

The present invention provides a lubricant composition suitable for direct fuel injected, crankcase-scavenged two-stroke cycle engines comprising a major amount of at least one oil of lubricating viscosity and a minor amount of an additive useful as a lubricity agent. The additive comprises an esterified polyalcohol, and an amine-phosphate.

Preferably, the esterified polyalcohol is an esterified glycerol. More preferably, it is glycerol monooleate.

Preferably, the amine-phosphate is an aliphatic aromatic amine-phosphate. More preferably, it is an acid aliphatic aromatic amine-phosphate having a phosphorus/oxygen atom ratio of from 4.0:1 to 4.5:1, and having at least 1.2 equivalents of acid to 1.0 equivalents of base.

Preferably, the additive also has a sulfur-containing organic inhibitor, such as sodium sulfonate.

In one embodiment, the lubricant composition also has a polyalkyl amide; an polyisobutylene; and a functionalized polyisobutylene.

The lubricant composition can be used in a method of lubricating a direct fuel injected, crankcase scavenged two-stroke cycle engine, comprising supplying the lubricant composition to the crankcase of the engine and operating the engine.

DETAILED DESCRIPTION OF THE INVENTION

In its broadest aspect, the present invention involves a lubricant composition suitable for direct fuel injected, crankcase-scavenged two-stroke cycle engines, That a lubricant composition comprises a major amount of at least one oil of lubricating viscosity, and minor amounts of an esterified polyalcohol and an amine-phosphate.

Oil of Lubricating Viscosity

The present invention relates to lubricating compositions and to lubricant fuels for two-stroke engines. The lubricating compositions useful for two-stroke cycle engines will compose a major amount by weight of at least one oil of lubricating viscosity and a minor amount of the present additives, sufficient to control piston ring sticking, reduce rust formation, and promote general engine cleanliness.

The lubricating compositions and methods of this invention employ an oil of lubricating viscosity, including natural or synthetic lubricating oils and mixtures thereof. Natural oils include animal oils, vegetable oils, mineral lubricating oils, solvent or acid treated mineral oils, and oils derived from coal or shale. Synthetic lubricating oils include hydrocarbon oils, halo substituted hydrocarbon oils, alkylene oxide polymers, esters of dicarboxylic acids and polyols, esters of phosphorus containing acids, polymeric tetrahydrofurans and silicon based oils.

Esterified Polyalcohol

The polyhydric alcohols from which the esters may be derived preferably contain up to about 40 aliphatic carbon atoms, preferably from 2 to 20, more preferably 2 to 10. Polyhydric alcohols include ethylene glycols, including di-, tri- and tetraethylene glycols; propylene glycols, including di-, tri-, and tetrapropylene glycols; glycerol; butane diol; hexane diol; sorbitol; arabitol; mannitol; sucrose; fructose; glucose; cyclohexane diol; erythritol; and pentaerythritols, including di- and tripentaerythritol; preferably, diethylene glycol, triethylene glycol, glycerol, sorbitol, pentaerythritol and dipentaerythritol.

The polyhydric alcohols are esterified with monocarboxylic acids having from 2 to 30 carbon atoms, preferably about 8 to about 18, provided that at least one hydroxyl group remains unesterified. Examples of monocarboxylic acids include acetic, propionic, butyric and fatty carboxylic acids. The fatty monocarboxylic acids have from 8 to 30 carbon atoms and include octanoic, oleic, stearic, linoleic, dodecanoic and tall oil acids. Specific examples of these esterified polyhydric alcohols include sorbitol oleates, including mono- and dioleate, sorbitol stearate, including mono and distearate, glycerol oleate, including glycerol di- and trioleate and erythritol octanoate.

Preferably, the esterified polyalcohol is an esterified glycerol. More preferably, it is glycerol monooleate.

Amine-Phosphate

Preferably, the amine-phosphate is an aliphatic aromatic amine-phosphate. More Preferably, it is an acid aliphatic aromatic amine-phosphate having a phosphorus/oxygen atom ratio of from 4.0:1 to 4.5:1, and having at least 1.2 equivalents of acid to 1.0 equivalents of base.

One embodiment of an acid aliphatic aromatic amine-phosphate is Vanlube® 692, sold commercially by the R. T. Vanderbilt Company, Inc.

Sulfur-Containing Organic Inhibitor

Sulfur-containing organic inhibitors can also be present. These are present in quantities enabling a synergistic effect when used in conjunction with the aromatic amine phosphate. It is also present in an amount sufficient to reduce degradation of the oil upon exposure to oxygen or to oxides of nitrogen. Sulfur-containing organic inhibitors include a variety of materials such as organic sulfides, organic polysulfides, sulfurized alkylphenols, and dithiocarbamates. Preferably, the sulfonate used in the invention is a sodium sulfonate.

One embodiment of a mixture of a sulfonate and an acid aliphatic aromatic amine-phosphate is Vanlube® 719, sold commercially by the R. T. Vanderbilt Company, Inc.

Other Additives

Other additives that are particularly useful in the present invention are imidazolines, such as 2-methylimidazoline, and polyalkyl amines, such as disclosed in U.S. Pat. No. 4,713,188, which is incorporated by reference for all purposes.

The compositions of the present invention may optionally contain up to 10% by weight of a polyisobutylene having a number average molecular weight from 400 to 2500, preferably about 950. This polyisobutylene is present in an amount up to 10% by weight, preferably up to 7%, more preferably about 5%, more preferably up to about 3% by weight. The polyisobutylene acts to improve lubricity and anti-scuff activity of the lubricant.

The compositions of the present invention may also optionally contain up to 10% by weight of a functionalized polyisobutylene having a number average molecular weight from 400 to 2500, preferably about 1300. The functional group for the olefin is typically amine based. This functionalized polyisobutylene is present in an amount up to 15% by weight, preferably up to 10%, more preferably about 5%, by weight. The functionalized polyisobutylene is therefore, a reaction product of the olefin and olefin polymers with amines (mono- or- polyamines). The functionalized polyisobutylene provides superior detergency performance in two-stroke cycle engines.

The invention also contemplates the use of other additives in combination with the compositions of this invention. Such additives include, for example, corrosion and oxidation inhibiting agents, pour point depressing agents, extreme pressure agents, antiwear agents, coke stabilizers and anti foam agents.

Auxiliary extreme pressure agents and corrosion and oxidation inhibiting agents, which may be included in the lubricants of this invention, are exemplified by chlorinated aliphatic hydrocarbons such as chlorinated wax and chlorinated aromatic compounds; organic sulfides and polysulfides; sulfurized alkylphenol; phosphosulfurized hydrocarbons; phosphorus esters; including principally dihydrocarbon and trihydrocarbon phosphites, and metal thiocarbamates.

Many of the above mentioned auxiliary extreme pressure agents and corrosion oxidation inhibitors also serve as antiwear agents. Zinc dialkylphosphorodithioates are a well known example.

Pour point depressants are a particularly useful type of additive often included in the lubricating oils described herein. The use of such pour point depressants in oil based compositions to improve low temperature properties of oil based compositions is well known in the art. See, for example, page 8 of "Lubricant Additives," by C. V. Smalheer and R. Kennedy Smith (Lezius Hiles Co. publishers, Cleveland, Ohio, 1967).

Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715.

Anti foam agents are used to reduce or prevent the formation of stable foam. Typical anti foam agents include silicones or organic polymers. Additional anti foam compositions are described in "Foam Control Agents," by Henty T. Kerner (Noyes Data Corporation, 1976), pages 125–162.

EXAMPLES

The invention will be further illustrated by following examples, which set forth particularly advantageous method embodiments. While the Examples are provided to illustrate the present invention, they are not intended to limit it.

Example 1

The lubricity agent performance evaluation was conducted by the Original Engine Manufacturer (OEM). The test facility included an OEM proprietary direct fuel injected engine, and, running in a 500 hour OEM proprietary engine test cycle. In this test, the lubricating oil was supplied to the OEM by the inventors. This test lubricant consisted of the complete lubricant formulation as detailed above, and, a lubricant formulation without the lubricity agent. Further, the lubricity agent was added to a third party lubricating oil formulation to investigate its effect.

In the test, the OEM would shut down the engine temporarily every 200 hours to inspect the engine. The end of test was targeted as 500 hours. Without the lubricity agent, the OEM could not find any lubricant oil formulation that could keep the engine running for the 500 hours. The lubricity agent when supplemented to existing lubricant oil formulations, helped the OEM reach the 500 hour end of test target, due to its superior performance in the areas of wear and anti-scuff protection. The observations of the OEM are detailed below:

When the lubricity agent was added, there was a reduction in wear of the anodized coating on the piston inlet skirt. Prior to using the lubricity agent, large areas of the coating had worn through revealing bare metal. Also, the piston rings were heavily worn-in after 400 hours, with 100% face contact of the top ring and about 80% face contact on the second ring. An attempt was made to determine the actual reduction in ring wear by weighing the rings before and after the test, but the differences were less than the accuracy of the measuring equipment.

Bore wear was determined by the amount of bore polishing. Without the lubricity agent both oil formulations showed excessive wear at top ring reversal, especialy on the inlet side (thrust) and areas above the exhaust port. The hone marks wre very light and irregular indicating a high degree of wear. With the lubricity agent, only a small amount of bore polishing was evident on the inlet side at top ring's top reversal. The hone marks on the remainder of the bore surfaces were still relatively fresh.

Example 2

The OEM conducted a 40 hour engine test to screen lubricants for the direct fuel injected two-stroke, crankcase scavenged engine. In this test, the complete lubricant formulation was used to evaluate its performance effectiveness. A merit rating is provided on a scale of 1–10, with 10 indicating clean engine parts and hence excellent lubricant performance.

The engine used was a three-cylinder, direct fuel injected two-stroke, crankcase-scavenged engine. In two of the three cylinders the above described lubricant formulation was utilized, while in the third cylinder an OEM reference oil was used (data not presented). The OEM evaluated the effectiveness of the oil formulation in the areas critical to engine performance and the results are given below:

| | Cylinder 1 | Cylinder 2 |
|---|---|---|
| PISTON VARNISH | | |
| Skirt Inlet | 9.8 | 9.8 |
| Skirt-Exhaust | 7.3 | 8.2 |
| Skirt-Front | 9.8 | 9.7 |
| Skirt-Rear | 7.3 | 9.2 |
| Crownland | 4.1 | 4.8 |
| Ringland: | 4.0 | 6.6 |
| DEPOSITS: | | |
| Piston Crown: | 8.5 | 8.5 |
| Piston Undercrown: | 4.6 | 6.7 |
| BIA RING STICK: | | |
| Top: | 9.5 | 9.0 |
| Bottom: | 10.0 | 9.0 |

As per the OEM's evaluation of the lubricant formulation, based on the above mentioned engine test, the oil was judged to be providing superior lubrication to the OEM engine.

Although the esterified polyalcohol and amine-phosphate additive of the present invention is especially useful for use in a lubricant composition suitable for direct fuel injected, crankcase-scavenged two-stroke cycle engines, this additive might also be useful in other lubricant compositions and in various fuel compositions.

While the present invention has been described with reference to specific embodiments, this application is intended to cover those various changes and substitutions that may be made by those skilled in the art without departing from the spirit and scope of the appended claims.

What is claimed is:

1. A lubricant composition suitable for direct fuel injected, crankcase-scavenged two-stroke cycle engines comprising:

(a) a major amount of at least one oil of lubricating viscosity;

(b) a minor amount of an additive comprising:
(1) an esterified polyalcohol, and
(2) an aliphatic aromatic amine-phosphate; and (c) a minor amount of a polyisobutylene having a number average molecular weight of from 400 to 2,500, wherein the amount of polyisobutylene is no more than 10 weight %.

2. A lubricant composition according to claim 1 wherein said esterified polyalcohol is an esterified glycerol.

3. A lubricant composition according to claim 2 wherein said esterified glycerol is glycerol monooleate.

4. A lubricant composition according to claim 1 wherein said aliphatic aromatic amine-phosphate is an acid aliphatic aromatic amine-phosphate having at least 1.2 equivalents of acid to 1.0 equivalents of base.

5. A lubricant composition according to claim 1 wherein said additive further comprises a sulfur-containing organic inhibitor.

6. A lubricant composition according to claim 5 wherein said sulfur-containing organic inhibitor is a sodium sulfonate.

* * * * *